US006481329B2

(12) United States Patent
Porter

(10) Patent No.: US 6,481,329 B2
(45) Date of Patent: Nov. 19, 2002

(54) SYSTEM FOR REMOTE CONTROL AND OPERATION

(75) Inventor: Don B. Porter, Avra Valley, AZ (US)

(73) Assignee: Delaware Capital Formation Inc., Wilmington, DE (US)

( * ) Notice: Subject to any disclaimer, the term of this patent is extended or adjusted under 35 U.S.C. 154(b) by 0 days.

(21) Appl. No.: 09/939,912

(22) Filed: Aug. 27, 2001

(65) Prior Publication Data

US 2002/0023532 A1 Feb. 28, 2002

Related U.S. Application Data

(63) Continuation of application No. 09/505,036, filed on Feb. 16, 2000, now Pat. No. 6,298,767.

(51) Int. Cl.[7] ..... F15B 21/04; F15B 13/04

(52) U.S. Cl. ..... 91/4 R; 91/461; 60/415; 166/344

(58) Field of Search ..... 91/4 A, 4 R, 5, 91/6, 461; 60/415; 166/363, 344

(56) References Cited

U.S. PATENT DOCUMENTS

| | | | | |
|---|---|---|---|---|
| 2,072,314 A | | 3/1937 | Rhodes | |
| 3,069,855 A | | 12/1962 | Denkowski et al. | |
| 3,100,965 A | | 8/1963 | Blackburn | |
| 3,124,371 A | | 3/1964 | Weir | |
| 3,151,455 A | | 10/1964 | Tennis | |
| 3,722,365 A | | 3/1973 | Olsson | |
| 3,940,217 A | * | 2/1976 | McCarthy et al. | 425/98 |
| 4,034,693 A | | 7/1977 | Challenger | |
| 4,095,421 A | | 6/1978 | Silcox | |
| 4,098,082 A | | 7/1978 | Packer | |
| 4,126,704 A | * | 11/1978 | McCarthy et al. | 426/304 |
| 4,309,786 A | | 1/1982 | Sharp et al. | |
| 4,337,829 A | | 7/1982 | Banzoli et al. | |
| 4,507,093 A | | 3/1985 | Norvell | |
| 4,553,600 A | | 11/1985 | Vigouroux et al. | |
| 4,579,136 A | | 4/1986 | Oman et al. | |
| 4,805,657 A | | 2/1989 | Carman et al. | |
| 4,821,775 A | | 4/1989 | Cooksey | |
| 4,970,936 A | | 11/1990 | Denker et al. | |
| 5,101,907 A | | 4/1992 | Schultz et al. | |
| 5,238,070 A | | 8/1993 | Schultz et al. | |
| 5,318,130 A | | 6/1994 | Manke | |
| 5,339,288 A | | 8/1994 | Blier et al. | |
| 5,357,999 A | | 10/1994 | Loth et al. | |
| 5,443,088 A | | 8/1995 | Hoch et al. | |
| 5,797,583 A | | 8/1998 | Murata et al. | |
| 6,125,938 A | | 10/2000 | Garcia-Soule et al. | |
| 6,298,767 B1 | * | 10/2001 | Porter | 166/344 |

* cited by examiner

*Primary Examiner*—John Ryznic
(74) *Attorney, Agent, or Firm*—Franklin L. Gubernick

(57) ABSTRACT

A system for remotely controlling an undersea device. The system employs a gas-pressurized liquid reservoir that can be recharged from at least one replaceable gas bottle. A pressure-regulating valve is employed to control the pressure of the liquid leaving the reservoir. A number of one-shot units, each in the form of a squib-actuated valve coupled with a piston accumulator, are employed to create a hydraulic pilot for a hydraulic direction control valve. The control valve functions to direct pressurized liquid from the reservoir to a hydraulic actuator or other type of hydraulic device.

11 Claims, 2 Drawing Sheets

SYSTEM FOR REMOTE CONTROL AND OPERATION

This is a Continuation of application Ser. No. 09/505,036 filed Feb. 16, 2000 now U.S. Pat. No. 6,298,767, issued Oct. 9, 2001.

FIELD OF THE INVENTION

The invention is in the field of control systems. More particularly, the invention is an electrically-controlled hydraulic system designed to enable the remote control of a device. In the preferred manner of use, the system employs a hydraulic actuator to control an undersea-located valve.

BACKGROUND OF THE INVENTION

It can sometimes be difficult to actuate or control a device, such as a hydraulic actuator for a valve, when the device is located in an area that is not readily accessible. In such cases, one must either employ a system for remotely-actuating/controlling the device, or one must gain access to the device and then operate it manually. Both of these methods can be costly. When manual operation is required, there can also be significant time delays, hazards, or external environmental conditions that limit access.

The above-described problems are commonplace when working with undersea-located devices. For example, undersea oil production control systems employ a number of valves in piping located on, or proximate, the sea floor. Since many of these valves are only actuated occasionally and/or are located where typical methods of remote control are unsatisfactory, operation of the valves is usually achieved manually by a diver or by a Remote-Operated-Vehicle (ROV). It should be noted that the problems associated with manual operation of an undersea-located device are exacerbated when the device is located at any significant depth below the water's surface.

There have been a number of systems devised to enable remote actuation of an undersea-located device. One such system is taught by Silcox in U.S. Pat. No. 4,095,421. In the Silcox patent, a surface-located acoustic transmitter is employed to send signals to a receiver located proximate an undersea-located rotary valve. Upon actuation, the receiver enables a negative-energy power supply to cause the operation of the rotary valve via a multi-valved actuator. This system has a number of limitations that arise due to the power supply and the arrangement of the valves.

Another example of a system for remotely operating an undersea-located device is taught by Carman et al in U.S. Pat. No. 4,805,657. The patent teaches a valve that includes a receiver and a spring-biased mechanism that can be triggered by an explosive bolt. Once the valve is installed in an undersea location, an operator can transmit an acoustic signal to the valve that will cause the detonation of the explosive bolt. Upon detonation, the spring-biased mechanism causes the valve to change from an open to closed, or closed to open position. Since this system only allows a single actuation of the valve, there is no practical method for testing the actuation system after the valve has been installed.

SUMMARY OF THE INVENTION

The invention is a system for remotely-actuating/controlling a device, such as a hydraulic valve actuator. In the preferred manner of deployment, the system is employed on an undersea-located device.

The system includes a pressurized fluid reservoir that can be recharged from one or more gas bottles. A fluid line extends between the reservoir and a main control valve. A pressure-regulating valve is preferably employed in said fluid line to maintain a constant pressure in the fluid going to the main control valve.

The main control valve functions to direct pressurized fluid from the reservoir to a hydraulically-powered device, such as a hydraulic actuator or a hydraulic motor. The control valve is preferably a spool valve and is operated through the action of a hydraulic pilot system.

The hydraulic pilot system preferably employs a "Christmas tree"/network of "one-shot" units. Each one-shot unit is preferably in the form of a squib-actuated valve and a piston accumulator. The pilot system functions by selectively enabling pressurized fluid to exert force on, and move, the control valve's spool. At the same time, the pilot system provides a flow path out of the control valve for fluid displaced by the spool's movement.

In the preferred embodiment, the squib-actuated valves of the hydraulic pilot system, and similar valves in the system for pressurizing the reservoir, are initially in a closed position. They can only be opened through the detonation of their squibs. An electrically-powered control system is used for this function.

The control system includes a receiver, controller and preferably a battery unit. In the preferred embodiment, all three of these devices are located proximate the controlled device.

The receiver functions to detect predetermined coded signals sent from a remotely-located transmitter. When the system is used to control an undersea-located device, an acoustic signal is preferred for transmitting a command from the transmitter to the receiver. To accomplish this, the sending unit of the transmitter is located in the water at a distance from the receiver. When the system is employed to control a device that is not near any surface-located structure, the sender unit of the transmitter can be suspended from a ship or lowered into the water from a helicopter. In operation, when the receiver detects a coded signal, it relays the signal to the controller.

The controller preferably includes a logic circuit that analyzes the signals received by the receiver. The controller then accomplishes the requested action by directing a detonating electric signal to certain of the squibs of the squib-actuated valves. This may result in a recharging of the reservoir and/or a functioning of the hydraulic pilot system to affect the control valve.

The above-described system enables remote operation of an actuator, valve or fluid motor in an improved manner compared to the prior art. The system is highly reliable, compact, easily serviceable and relatively low in cost. In the preferred design of the system, there are sufficient "one-shot" units to enable multiple cycling of the controlled device. As a result, the system has an extended service life and the system's reliability and functionality can be tested.

BRIEF DESCRIPTION OF THE DRAWS

DETAILED DESCRIPTION OF THE DRAWINGS

Figure 1:
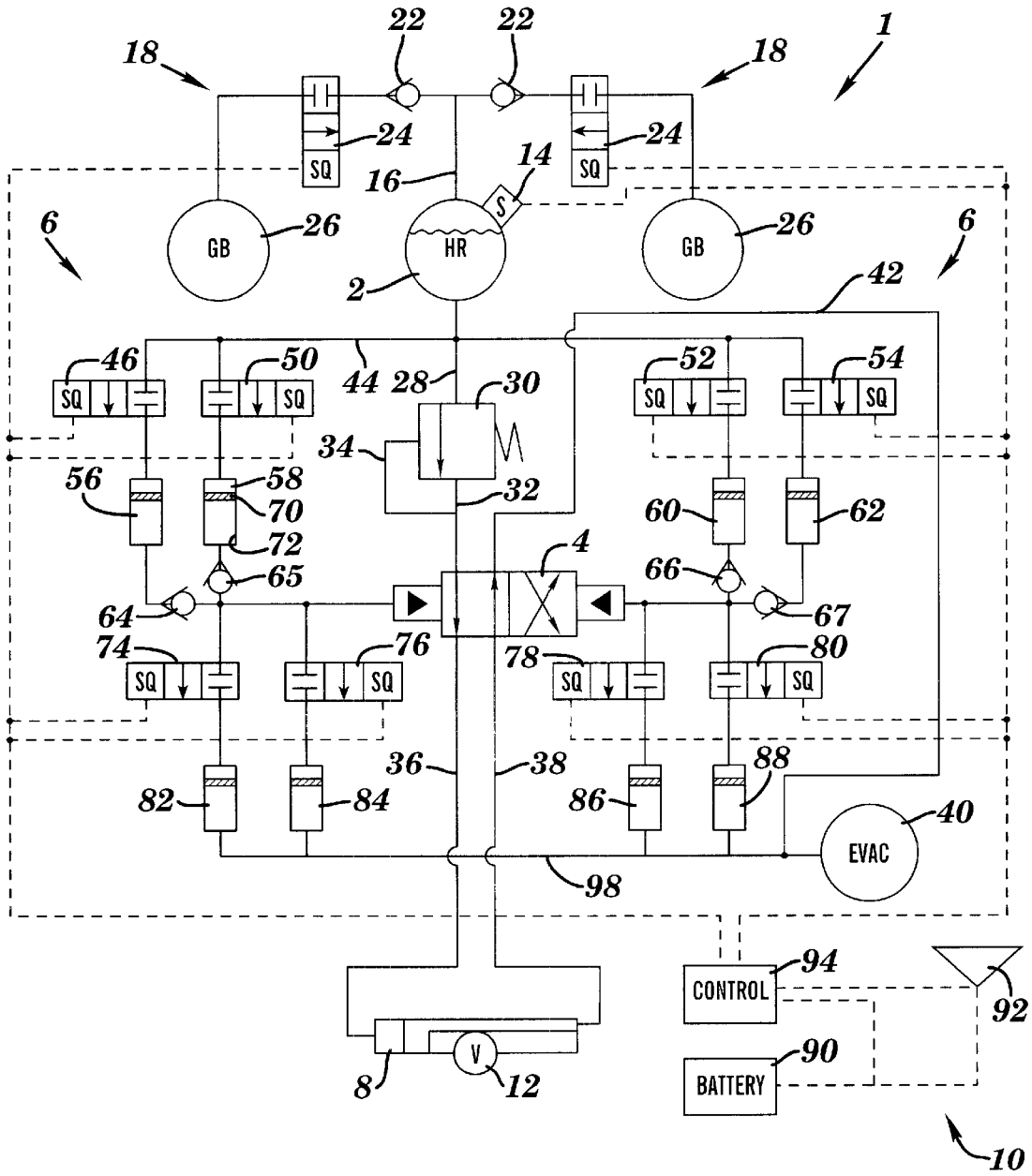
FIG. 1 is a schematic diagram of a control/actuation system in accordance with the invention.

Referring now to the schematic diagrams in greater detail, wherein like characters refer to like parts throughout the several figures, there is shown by the numeral 1 a control/actuation system in accordance with the invention. All of the individual components shown are conventional and commercially available. In the diagrams, the straight solid lines indicate fluid lines, while the straight dashed lines indicate electrical lines/wires. It should be noted that a fluid line can be a passage, conduit, tube, pipe or any other well-known structure for conducting a fluid.

The main elements of the system 1 are a hydraulic reservoir 2, a main control valve 4, a hydraulic pilot system 6, a hydraulic actuator 8, and an electrically-powered control system 10. The hydraulic actuator is shown operating a valve 12.

The hydraulic reservoir 2 is partially filled by a volume of liquid, such as a biodegradable oil. Also located within the reservoir is a volume of gas that functions to pressurize the liquid. While a direct gas-liquid interface is shown, other forms of pressure application may be employed wherein a movable element, such as a piston or diaphragm, is located between the volume of liquid and volume of gas. An optional pressure sensor 14 is connected to the reservoir and measures the pressure of the contained liquid.

Leading to the reservoir is a fluid line 16 that connects to two charging circuits 18. Each charging circuit includes a one-way valve 22, a squib-actuated valve 24 and a removable gas bottle 26. The gas bottle preferably contains air or nitrogen that has been compressed and is at a very high pressure. When the squib of either of the valves 24 is detonated, the position of the associated valve changes from closed to open. Since the reservoir will normally be at a pressure lower than that of the gas within the gas bottle, the gas will flow from the bottle 26, through the associated valve 24, through valve 22, through line 16, and into the reservoir 2. This effectively increases the pressure of the fluid within the reservoir 2.

The one-way valves 22 perform two functions. Firstly, they prevent pressurized gas from flowing back into a gas bottle. For example, if one bottle has already been used to pressurize the reservoir, and it is time to re-pressurize the reservoir from the second bottle, the one-way valves prevent gas from flowing from one gas bottle to the other. Secondly, since the gas bottles are replaceable, the one-way valves allow a gas bottle and squib valve to be removed without the loss of fluid or gas from the system.

It should be noted that while two charging circuits are shown, a fewer or greater number of charging circuits can be employed. The number of charging circuits required is dependent on the demands that will be placed on the reservoir. If the reservoir is initially pressurized sufficiently to meet its demands, the charging circuits can be eliminated entirely. It should also be noted that while a squib-actuated valve 24 is shown in the figure, the valve can be replaced with other well-known equivalent squib-actuated devices that enable fluid flow from a gas bottle. An example of such a device is shown in U.S. Pat. No. 4,970,936 wherein an end portion of a gas bottle is fractured to enable the flow of gas out of the bottle and into a fluid line.

Leading out of the bottom of reservoir 2 is a fluid line 28. A pressure-regulating valve 30 is located in the fluid line and functions to regulate the pressure of the liquid leaving the valve via line 32. The valve includes a sensor line 34 that taps into line 32 downstream from the valve 30. Fluid line 32 leads to the main control valve 4.

Control valve 4 is a conventional two-position, four-way, direction control spool valve. Lateral movement of the valve's center-located spool (not shown) allows the flow of pressurized fluid from line 32 to the actuator 8 via one or the other of outlet lines 36 or 38. The chosen line to the actuator is dependent on the direction in which the spool has been shifted.

Movement of the spool is controlled by the hydraulic pilot system 6.

The hydraulic pilot system affects the control valve 4 in a conventional manner. The control valve includes a fluid-filled area located adjacent each end of the spool. The pilot system functions to increase the pressure of the fluid in one of said areas, while fluid in the other of said areas is allowed to flow out of the valve. This causes the spool to shift laterally, away from the area where the fluid pressure has been increased. As the spool moves, it enables two simultaneous flow paths through the valve. The first path is for pressurized fluid to travel from the reservoir 2, through the valve 4, and then to the actuator 8 via one of lines 36 or 38. The second flow path is for fluid to flow from the actuator 8, back to valve 4 via the other of lines 36 or 38, and then to an evacuated return line chamber, or sump, 40 via fluid line 42.

The pressure side of the pilot system, as shown in the figures, receives pressurized fluid from the reservoir via a line 44 that taps into line 28. The pressurized fluid can then flow into one of four fluid paths. Each fluid path contains a "one-shot" unit that governs the path's fluid flow.

Each of the above-noted one-shot units comprises a squib-actuated valve and an associated piston accumulator. As shown in the figures, each one-shot unit of the pressure side of the pilot system includes a squib-actuated valve 46, 50, 52 or 54 and an associated piston accumulator 56, 58, 60 or 62 respectively. A one-shot unit is hereby defined as a device, or assembly of devices, that when actuated, will perform a predetermined function only once. If the unit is to be reused, it must be physically reloaded and/or reset.

Additionally, each fluid path of the pressure side of the pilot system includes a one-way valve 64, 65, 66, or 67, located immediately downstream of one of the above-listed accumulators. The one-way valves allow fluid to flow toward the control valve and prevent a reverse flow of fluid.

It should be noted that each of the above-noted squib-actuated valves is initially in a closed/flow-preventing position. The valve's position is changed through the detonation of its associated squib. In the preferred embodiment, the squib-actuated valves are conventional in design. Examples of typical squib valves are taught in U.S. Pat. Nos. 4,821,775 and 5,443,088.

The above-noted piston accumulators, also known in the industry as transfer cylinders, are conventional in design. Each accumulator includes a floating piston 70 that is in sealing engagement with the accumulator's cylindrical interior wall 72. When an unbalanced pressure is applied to the piston, the piston will move from one end of the cylinder to the other. As is common in most arrangements wherein a piston moves within a cylinder, movement of the piston draws fluid into one end of the accumulator while causing fluid to be expelled from the accumulator's other end. Once the piston has moved in one direction, a reverse movement of the piston can only occur due to an opposite imbalance of fluid pressure on the piston. In this manner, fluid can only flow once through an opened squib-actuated valve. After fluid flow has caused an accumulator's piston to move to the bottom of the accumulator, the accumulator will prevent any further flow through the associated flow path. In this manner, fluid has only one shot at flowing into any of the flow paths having a one-shot unit.

The return side of the hydraulic pilot shown in the figures includes four fluid paths connected to the main control valve and capable of receiving fluid displaced by a lateral movement of the control valve's spool. Similar to the pressure side of the pilot system, each of these fluid paths contains a one-shot unit having an initially-closed squib-actuated valve 74, 76, 78, or 80 and an associated piston accumulator 82, 84, 86 or 88, respectively. The piston accumulators are preferably structurally identical to the piston accumulators 56–62. While the pressure side of the hydraulic pilot includes one-way valves 64–67, similar valves are unnecessary for the return side. This is allowable since the path of least resistance for fluid leaving any of the accumulators 82–88 is to the sump 40 via line 98. Additionally, even if the fluid flowing out of one of said accumulators went into an accumulator that had already had its piston moved by fluid flow, the fluid would have no affect on the piston since the pressure of the fluid would be less than that of the fluid acting on the other side of the piston.

As noted previously, the purpose of the hydraulic pilot is to affect the position of the main control valve's spool. By affecting the spool position, one causes a desired flow of fluid to the actuator 8.

The hydraulic valve-actuator 8 is preferably conventional in design, wherein pressurized fluid applies force on a piston to caused said piston to move. In the actuator shown, pressurized fluid is delivered to the actuator 8 from one of lines 36 or 38. As the piston moves, displaced fluid is expelled from the actuator and flows into the other of lines 36 or 38. When the invention is employed to control/actuate an undersea-located device, the actuator 8 is preferably a balanced area-type actuator since the sea pressure would have no affect on the device other than in seal friction.

In the preferred embodiment, the actuator 8 acts on a device, such as valve 12, that is installed in a non-related system. Movement of the actuator's piston causes a portion of the actuator to exert force on a portion of the valve, such as the valve's stem. This will cause the valve 12 to open or close, depending on the direction of the piston's travel.

It should be noted that the system 1 can be used to actuate/control any type of device affected by, or employing, a movable element. The primary goal of the system 1 is to accomplish, in response to a signal transmitted from a remote location, either a direct or indirect movement of said element. For example, while a valve actuator 8 and valve 12 are shown, one or both of these devices can be replaced by a hydraulic motor, safety release device, movable arm, elevator platform, switching unit, a different type of hydraulic actuator, etc. In its most general manner of use, the system is employed to actuate/control a device that is in a non-readily accessible area. In the preferred manner of use, the system is employed to actuate/control a device located in an undersea environment.

The operation of the system 1 is controlled by the electrically-powered control system 10. The system 10 features a battery unit 90, a receiver 92, a controller 94 and electrical connections to all of the squibs of the system's squib-actuated valves. As noted previously, the dashed lines shown in FIGS. 1 and 2 represent the electrical connections between the different elements of the system 10.

The battery unit 90 is preferably conventional in design. Such units typically include one or more replaceable long-life storage batteries.

The receiver 92 functions to receive signals transmitted to the system 1 from a remote location. In the preferred manner of use, wherein a subsea-located device is being controlled by the system, the receiver 92 is of a type capable of receiving acoustic signals. The receiver then relays said signals to the controller 94 via the electrical connection between the two units. In instances where the system is electrically-connected to the transmitter via a wire or other conventional means, the receiver may simply be a lead of the controller to which the wire is connected.

The controller 94 preferably includes a logic circuit (not shown). Besides being connected to the receiver and battery, the controller is connected to each of the system's squibs and to the reservoir's sensor 14. It should be noted that the system 1 can also include a controller-connected sensor at each squib-actuated valve for providing the controller with information about whether the associated valve is open or closed. The actuator 8 may also include a controller-connected sensor to provide the controller with information about the actuator position and/or the about whether the valve 12 is open or closed.

Figure 2:
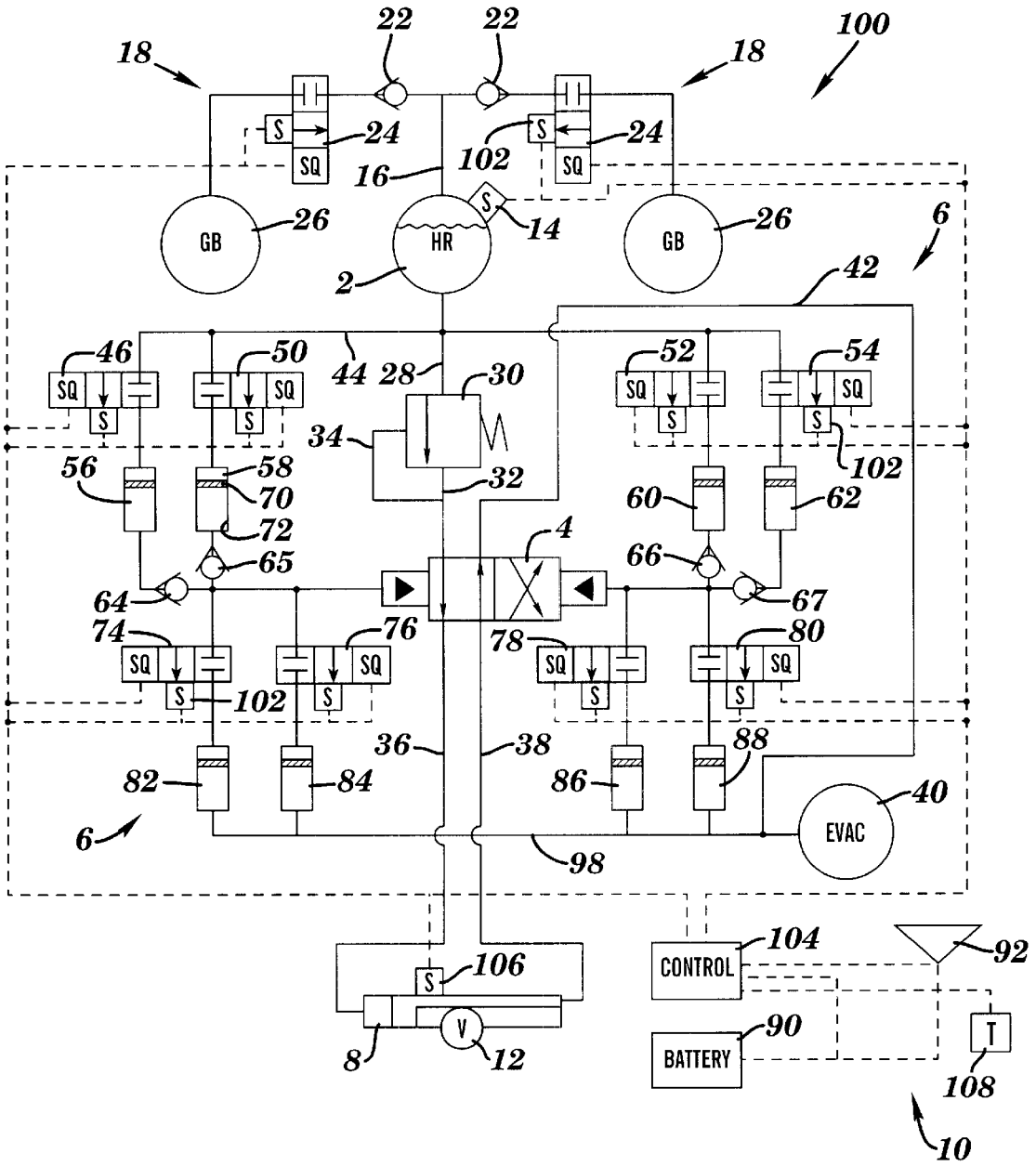
FIG. 2 is a schematic diagram of a modified version of the control/actuation system shown in FIG. 1.

FIG. 2 provides a schematic drawing of a control/actuation system 100 that is basically identical to the system 1, except for changes in the control system 10. Each squib-actuated valve includes a sensor 102 that is depicted in the figure by an enclosed 'S'. For clarity of the figure, only some of the sensors are numbered. Each sensor is electrically-connected to the controller 104 and functions to inform the controller about whether the associated valve is open or closed. The controller 104 is functionally similar to controller 94.

Also electrically-connected to the controller is a position sensor 106 that is shown mounted on the actuator 8 and provides information to the controller about the position of a movable element of the actuator. Alternatively, the sensor 106 may be secured to the valve 12 and provide information to the controller about whether the valve is open or closed. As in the previous embodiment, the reservoir's optional sensor 14 is electrically-connected to the controller and provides information to the controller about the pressure of the fluid within the reservoir.

While a receiver provides the minimum capability for the invention, the system 100 shown in FIG. 2 also includes a transmitter 108. In the preferred manner of use, wherein the system is used to control/actuate a subsea-located valve, the receiver 92 and transmitter 108 are included in a single unit as a transponder. The transmitter is electrically-connected to, and operated by, the controller and functions to transmit signals to a remote location to inform an operator about the status of one or more of the system's different components.

To describe how the system 1 or 100 would operate, the following example is provided.

In a typical usage, the valve 12 is installed in an underwater oil pipeline as an emergency valve. In such an installation, the valve is normally open, and fluid can flow through the valve. If the pipeline should suffer damage, part of the damage control procedure may require an operator to transmit a signal to the system 1 (or 100) ordering the valve 12 closed. Once the signal is picked-up by the receiver 92, the signal is relayed to the controller 94 (or 104) for verification and action. The controller analyzes the signal and then sends an electric impulse to the squibs of valves 46 and 80, causing the squibs to explode and the associated valves to change to an open position.

If the reservoir is not in a fully-pressurized condition, the controller may also at this time send an electric impulse to a squib associated with one of the valves 24 that is in a closed position. This would detonate the squib and cause the valve 24 to open. Pressurized gas from the associated gas bottle 26 would then flow to, and thereby pressurize, the reservoir 2. It should be noted that a determination to charge the reservoir can be based on input to the controller from optional sensor 14, or by the controller's logic circuit in a predetermined manner. For example, the logic circuit may include a command whereby the controller will cause the reservoir to be charged whenever either of valves 46 or 50 is caused to open.

When the controller caused valve 46 to open by detonating its squib, pressurized fluid immediately began flowing from line 44, through valve 46, and into piston accumulator 56. This causes the accumulator's piston to move downwardly, thereby expelling fluid from the other end of the accumulator. The expelled fluid goes through one-way valve 64 and applies pressure to the left end of the spool (not shown) located within the main control valve 4. As the spool begins moving to the right due to the applied pressure, some of the fluid contacting the right end of the main control valve's spool is displaced, and flows through now-open valve 80. This fluid flows into accumulator 88, and moves the accumulator's piston from one end of the accumulator to the other. The moving piston causes fluid to be expelled from the other end of the accumulator, where it travels to the sump 40 via line 98.

Once the pilot system has moved the main control valve's spool to the right by a predetermined amount, various ports within the main control valve become uncovered. As a result, pressurized fluid from line 32 flows through the valve and into line 36. It should be noted that pressure-regulating valve 30 functions to maintain the correct pressure of the fluid going to the control valve 4.

The pressurized fluid travels through line 36 and then into the actuator 8. This fluid applies pressure on the piston within the actuator, causing the piston to move to the right. As the piston moves, it pushes fluid out of the actuator. The expelled fluid goes into line 38, back to the control valve, and then to the sump 40 via line 42. It should be noted that as the actuator's piston moves to the right, a portion of the actuator applies pressure on an element of the valve 12, such as the valve's stem, and causes the valve to close.

The system shown in FIG. 2 would function in the same manner as described above. However, the system's sensors, including the sensor in the reservoir, the sensor in the actuator, and the sensors of the squib-actuated valves, would all provide information to the controller about their status. The controller would then transmit some or all of this information, via the transmitter 108, to the remotely-located operator.

To continue the example, after the pipeline has been repaired, the operator transmits a signal to the system 1 (or 100) to re-open the valve 12. Upon receipt of the proper signal, the controller detonates the squibs in valves 54 and 74.

In the preferred embodiment, each gas bottle would include a sufficient charge of pressurized gas to enable a full cycling of the actuator. However, if necessary, the controller could recharge the reservoir through the detonation of a squib in one of the still-closed valves 24.

By firing the squib in valve 54, pressurized fluid is allowed to travel from line 44, through the valve and into one end of the accumulator 62. The fluid pushes the accumulator's piston down, thereby causing fluid to be expelled from the other end of the accumulator. The expelled fluid goes through the one-way valve 67, into the control valve 4, and applies pressure on the right end of the control valve's spool. As the spool moves to the left, some of the fluid located in the control valve adjacent the left end of the spool is forced out of the control valve, through now-open valve 74 and into accumulator 82. It should be noted that one-way valve 64, located in the path to accumulator 56, prevents fluid from instead going to accumulator 56. As the piston in accumulator 82 moves downwardly, it forces fluid out of the accumulator and into the sump 40 via line 98.

Once the spool in control valve 4 has moved a sufficient distance to the left of center, a new flow pattern is enabled through the valve 4. Pressurized fluid from line 32 now goes through the control valve, through line 38 and into the right side of actuator 8. This causes the piston in actuator 8 to move to the left, and re-open valve 12. Fluid displaced from the left side of actuator 8 flows through line 36, through the control valve and then to the sump via line 42.

The above completes one full cycle of the controlled device, the valve 12. If the operator needs to close valve 12 again, he or she sends an appropriate signal to the system 1. Upon receipt of the signal, the controller this time detonates the squibs in squib-actuated valves 50 and 78. These valves open, thereby enabling a fluid flow, via accumulators 58 and 86, that causes the control valve's spool to move to the right. This establishes a fluid flow, via lines 36 and 38, that causes the actuator 8 to close valve 12.

To reopen valve 12, the operator would send the appropriate signal to the controller, and the controller would detonate the squibs in squib-actuated valves 52 and 76. These valves would open, and fluid would flow to the control valve via accumulator 60, and away from the control valve via accumulator 84, to cause a movement of the control valve's spool to the left. This would again establish a fluid flow to the actuator 8 to cause the actuator to open valve 12.

In the preferred embodiment, the controller includes sufficient memory to keep track of which of the squibs have already been detonated. For example, after the valve 12 has been opened and closed once via the firing of the squibs associated with valves 46, 80, 54 and 74, the controller would know to detonate the squibs for valves 50 and 78 to cause the closure of valve 12. Alternatively, and as shown in FIG. 2, each of the squib-actuated valves can include a sensor that provides information to the controller relative to the valve's position. In this manner, the controller would be able to tell which valves are in an open, or closed, position.

Therefore, for the system shown in either figure, an operator can cause two complete cycles of the main control valve 4, and hence of the controlled device, valve 12. If one desired a system in which more cycles of the controlled device could be accomplished, one could modify the pilot system shown by adding additional flow paths that include one-shot units, following the pattern shown in the figure. Furthermore, if one only wanted to accomplish a single cycle of the control valve, one could eliminate a set of flow paths in the pilot system, i.e.—by eliminating the flow paths that include valves 50, 52, 76 and 78, and accumulators 58, 60, 84 and 86.

Once all of the squibs in the pilot system have been detonated, the system can no longer cause any action in the controlled device. To become functional again, some or all of the squibs must be replaced, as well as a manual resetting of some, or all, of the piston accumulators. Additionally, one would also replace any empty gas bottles, and if necessary, the battery unit. These actions can be taken at a repair facility, or in situ. When the unit is employed to control an undersea-located device, the in situ recharging/resetting can be accomplished by a diver or ROV.

While a spool valve is preferred for use as control valve 4, this valve can be replaced by other types of equivalent control valves. For example, a rotary valve, or a combination of single-acting valves, may be employed as a control valve 4.

It should be noted that for some applications, the one-shot units described for use in the pilot system may include only squib-actuated valves. However, such a system, without the flow limiting qualities of the accumulators, must have either fewer flow paths, or a different method for limiting fluid flow once a squib-actuated valve has been opened by the controller.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A system for remotely-controlling a device, said system comprising:

a pressurized fluid reservoir;

a main control valve operatively connected to said reservoir;

a hydraulic pilot operatively connected to a source of pressurized fluid and to said main control valve, wherein said hydraulic pilot comprises a first fluid path and a second fluid path, wherein each of said fluid paths includes a one-shot unit that comprises a squib-actuated valve and a piston accumulator, wherein said first fluid path connects to said main control valve and can receive pressurized fluid from said source of pressurized fluid, wherein said second fluid path connects to said main control valve and can direct liquid into a fluid sump, wherein when said squib-actuated valves are open, fluid will flow into the piston accumulator in the first fluid path and push a piston of said accumulator a predetermined distance, whereby once said piston has moved said distance, the piston will then stop and no further fluid will be able to flow into said first fluid path, and wherein movement of said piston will cause fluid from said first fluid path to flow through a one-way valve in said path and then apply pressure in a first direction to a movable portion of said control valve while fluid can be displaced from said control valve and flow into said second fluid path;

an electrically-powered controller, wherein said controller is operatively connected to a receiver capable of receiving a signal transmitted to said receiver from a remote location, wherein said controller is electrically-connected to a squib in each of said squib-actuated valves; and a device operatively connected to said main control valve, wherein said device is actuated by a flow of fluid, wherein when said receiver receives a predetermined signal, the controller will cause the detonation of said squibs and thereby open said squib-actuated valves, thereby causing the movable portion of said main control valve to move in a first direction to thereby enable fluid to flow from said reservoir to said device and cause a movable portion of said device to move.

2. A system for remotely-controlling a device, said system comprising:

a pressurized fluid reservoir;

a main control valve operatively connected to said reservoir;

a hydraulic pilot operatively connected to a source of pressurized fluid and to said main control valve, wherein said hydraulic pilot comprises a first fluid path and a second fluid path, wherein a first squib-actuated valve is located in said first fluid path and a second squib-actuated valve is located in said second fluid path, wherein said first fluid path connects to said main control valve and can receive pressurized fluid from said source of pressurized fluid, wherein said second fluid path connects to said main control valve and can direct liquid into a fluid sump, wherein when said first and second squib-actuated valves are open, pressurized fluid from said first fluid path can apply pressure in a first direction to a movable portion of said control valve while fluid can be displaced from said control valve and flow into said second fluid path;

an electrically-powered controller, wherein said controller is operatively connected to a receiver capable of receiving a signal transmitted to said receiver from a remote location, wherein said controller is electrically-connected to a first squib that forms a part of said first squib-actuated valve and to a second squib that forms a part of the second squib-actuated valve; and a device operatively connected to said main control valve, wherein said device is actuated by a flow of fluid, wherein when said receiver receives a predetermined signal, the controller will cause the detonation of said first and second squibs and thereby open said first and second squib-actuated valves, thereby causing the movable portion of said main control valve to move in a first direction to thereby enable fluid to flow from said reservoir to said device and cause a movable portion of said device to move.

3. The system of claim 2 wherein said first fluid path also includes a piston accumulator located between the first squib-actuated valve and the control valve, wherein when said first squib-actuated valve is initially opened by said controller, fluid will then flow into said piston accumulator and push a piston of said accumulator a predetermined distance, whereby once said piston has moved said distance, the piston will then stop and no further fluid will be able to flow into said first fluid path.

4. The system of claim 2 wherein said hydraulic pilot also includes a third fluid path and a fourth fluid path, wherein a third squib-actuated valve is located in said third fluid path and a fourth squib-actuated valve is located in said fourth fluid path, wherein said third fluid path connects to said main control valve and can receive pressurized fluid from said source of pressurized fluid, wherein said fourth fluid path connects to said main control valve and can direct liquid into a fluid sump, wherein when said third and fourth squib-actuated valves are open, pressurized fluid from said third fluid path can apply pressure to a movable portion of said control valve in a second direction opposite to said first direction while fluid can be displaced from said control valve and flow into said fourth fluid path; and wherein said controller is electrically-connected to a third squib that forms a part of said third squib-actuated valve and to a fourth squib that forms a part of the fourth squib-actuated valve.

5. The system of claim 4 wherein said hydraulic pilot also comprises a fifth fluid path identical to said first fluid path, a sixth fluid path identical to said second fluid path, a seventh fluid path identical to said third fluid path, and an eighth fluid path identical to said fourth fluid path, wherein a fifth squib-actuated valve is located in said fifth fluid path, wherein a sixth squib-actuated valve is located in said sixth fluid path, wherein a seventh squib-actuated valve is located in said seventh fluid path, and wherein an eighth squib-actuated valve is located in said eighth fluid path; and wherein said controller is electrically-connected to squibs that form a part of squib-actuated valves in each of said fifth through eighth fluid paths, and wherein an operator can cause four separate movements of said movable portion of said device by causing the controller to fire certain of the squibs in the hydraulic pilot.

6. The system of claim 2 wherein said device operatively connected to said main control valve is a hydraulic actuator.

7. The system of claim 6 further comprising a sensor and a transmitter, wherein said sensor and transmitter are both electrically-connected to said controller, wherein said sensor is operatively connected to said actuator and is capable of relaying information to said controller that indicates the position of a portion of the actuator, and wherein said controller can relay said information to a remote location via said transmitter.

8. The system of claim 2 wherein the fluid reservoir is the source of pressurized fluid to which the hydraulic pilot is operatively-connected.

9. The system of claim 2 wherein said first flow path also includes a one-way valve that only allows fluid flow in a direction leading to the main control valve.

10. The system of claim 4 wherein each of the first and third flow paths also includes a one-way valve that only allows fluid flow in a direction leading to the main control valve.

11. The system of claim 5 wherein the fifth flow path joins the first flow path at a location between the first flow path's one-way valve and the main control valve.

* * * * *